US010054324B2

(12) United States Patent
Marchetti et al.

(10) Patent No.: US 10,054,324 B2
(45) Date of Patent: Aug. 21, 2018

(54) CLOSE HUMIDITY AND TEMPERATURE CONTROL METHOD

(71) Applicant: SCHNEIDER ELECTRIC IT CORPORATION, West Kingston, RI (US)

(72) Inventors: Daniele Marchetti, Chioggia (IT); Fabio Greggio, Terrassa Padovana (IT)

(73) Assignee: SCHNEIDER ELECTRIC IT CORPORATION, West Kingston, RI (US)

( * ) Notice: Subject to any disclaimer, the term of this patent is extended or adjusted under 35 U.S.C. 154(b) by 203 days.

(21) Appl. No.: 14/851,891

(22) Filed: Sep. 11, 2015

(65) Prior Publication Data

US 2017/0074538 A1 Mar. 16, 2017

(51) Int. Cl.

| | |
|---|---|
| ***F24F 3/14*** | (2006.01) |
| ***F25B 13/00*** | (2006.01) |
| ***F25B 7/00*** | (2006.01) |
| ***F25B 49/00*** | (2006.01) |
| ***F24F 11/00*** | (2018.01) |
| ***F24F 11/30*** | (2018.01) |
| ***F24F 11/62*** | (2018.01) |

(Continued)

(52) U.S. Cl.

CPC ..... *F24F 11/0012* (2013.01); *F24F 11/30* (2018.01); *F24F 11/62* (2018.01); *F24F 11/70* (2018.01); *F24F 11/63* (2018.01); *F24F 2110/10* (2018.01); *F24F 2110/20* (2018.01)

(58) Field of Classification Search

CPC .. F24F 11/0012; F24F 11/0015; F24F 11/006; F24F 11/0076; F24F 2011/0061

USPC ..... 62/160, 175, 176.6

See application file for complete search history.

(56) References Cited

U.S. PATENT DOCUMENTS 3,651,864 A * 3/1972 Maddox, Jr. ..... F24F 11/085 165/228

4,018,584 A * 4/1977 Mullen ..... F24F 11/08 62/175

(Continued)

FOREIGN PATENT DOCUMENTS

WO 2011/062080 A1 5/2011

OTHER PUBLICATIONS

What are the Benefits of Normalization (Scaling Values between 0 and 1) in Statisitics ("Normalization") (published Mar. 13, 2015).*

(Continued)

*Primary Examiner* — Henry Crenshaw

(74) *Attorney, Agent, or Firm* — Lando & Anastasi, LLP

(57) ABSTRACT

According to various aspects and embodiments, a system and method for controlling humidity and temperature are disclosed. The system includes temperature and humidity sensors, at least one unit configured to cool, heat, dehumidify, and humidify air, and a control module. The control module is configured to receive set point values for the temperature and humidity and to receive measured air and temperature values from the sensors. The control module then calculates differences between the measured values and the set point values to determine respective temperature and humidity error values. The control module controls the operation of the at least one unit based on a comparison between the temperature error value and the humidity error value.

13 Claims, 13 Drawing Sheets

(51) Int. Cl.

| | |
|---|---|
| ***F24F 11/70*** | (2018.01) |
| *F24F 110/10* | (2018.01) |
| *F24F 110/20* | (2018.01) |
| *F24F 11/63* | (2018.01) |

(56) References Cited

U.S. PATENT DOCUMENTS

| | | | | |
|---|---|---|---|---|
| 4,869,073 | A * | 9/1989 | Kawai | F24F 11/0009 236/44 C |
| 4,889,280 | A | 12/1989 | Grald et al. | |
| 5,346,129 | A | 9/1994 | Shah et al. | |
| 5,632,333 | A * | 5/1997 | Imamura | B01D 53/265 165/228 |
| 5,737,934 | A | 4/1998 | Shah | |
| 5,915,473 | A | 6/1999 | Ganesh et al. | |
| 6,012,296 | A | 1/2000 | Shah | |
| 6,557,771 | B2 | 5/2003 | Shah | |
| 2003/0061822 | A1 * | 4/2003 | Rafalovich | F24F 3/1405 62/92 |
| 2004/0244393 | A1 * | 12/2004 | Lucas | F04B 39/066 62/186 |
| 2005/0155369 | A1 * | 7/2005 | Ootori | F24F 11/001 62/228.1 |
| 2006/0123812 | A1 * | 6/2006 | Posch | F24F 3/1405 62/176.6 |
| 2011/0196540 | A1 * | 8/2011 | Engelhardt | B64D 13/06 700/278 |
| 2013/0091881 | A1 | 4/2013 | Ito et al. | |
| 2014/0242899 | A1 | 8/2014 | Liu | |
| 2016/0076831 | A1 | 3/2016 | Marchetti | |

OTHER PUBLICATIONS

Extended European Search Report corresponding to European Application No. 16188066.1 dated Jan. 11, 2017.

* cited by examiner

CLOSE HUMIDITY AND TEMPERATURE CONTROL METHOD

BACKGROUND

Technical Field

The present invention relates generally to the field of temperature and humidity control, and more particularly, to simultaneous control of temperature and humidity.

Background Discussion

Many rooms or enclosed spaces contain equipment or objects that are sensitive to both temperature and humidity. For example, museums and other archive facilities, as well as measurement, manufacturing, cleanroom, and lab environments may require maintaining near-constant temperature and humidity levels, since both the values and any fluctuation in these environmental factors has the potential of damaging the contents or detrimentally influencing operations in these spaces. Simultaneous control of both temperature and humidity is complicated by the fact that relative humidity is a function of not only moisture content, but also air temperature.

Direct expansion (DX) air conditioners are useful in small to medium sized buildings and have certain advantages over conventional chilled-water based air conditioning (AC) systems, such as having higher energy efficiency and lower ownership and maintenance costs. DX systems generate conditioned air via a refrigeration cycle using compressors. Liquid refrigerant passes through an expansion device, which is typically a valve, just before entering a cooling coil (an evaporator). The expansion device reduces the pressure and temperature of the refrigerant to the point where it is colder than the air passing through the coil. Cooling is accomplished by blowing air over the cooling coil. DX systems owe their efficiency to the fact that the air used for cooling a conditioned space is directly chilled by the refrigerant in the cooling coil of the air handling unit. As shown in FIG. 1, the components of a DX system typically include an evaporator, a compressor, a condenser, and an expansion device, although any system that uses refrigerant and an evaporator coil can be called a DX system.

DX systems also present difficulties in controlling both temperature and humidity, since in most DX systems the cooling coil must simultaneously perform both cooling and dehumidification functions. For instance, in reference to FIG. 2, an example of a conventional temperature and humidity control system is illustrated, where temperature control is accomplished by either cooling the air using a compressor or heating the air using a heater. Control of the humidity is accomplished by cooling the air to a temperature below the dew point temperature, which is the temperature at which water condenses from air, using a compressor and then either subsequently heating the air by means of a heater, or injecting water vapor using a humidifier. DX systems equipped with a single-speed compressor and supply fan rely on on/off cycling of the compressor for providing an economical, but discontinuous approach to temperature control. This configuration gives priority to temperature control, with control of humidity being secondary. Under these operating conditions, the level of precision for the regulation of humidity is ±7-8%, which is inadequate for many of the applications mentioned above, which may require the precision for humidity control to be within ±5%.

Humidity can be more closely controlled, as shown in FIG. 3, by continuously operating the compressor, which allows the DX device to dehumidify the air, but results in air that is too dry and/or too cool. Therefore, the humidifier operates continuously to humidify the air, and the heater may also be operated more frequently. This configuration leads to increased energy and maintenance costs, since the compressor and humidifier are in constant operation.

SUMMARY

A first aspect of the invention is directed to an improved humidity and temperature control system. The humidity and temperature control system includes a temperature sensor configured to measure an air temperature value, a humidity sensor configured to measure an air humidity value, at least one unit configured to cool, heat, dehumidify, and humidify air, and a control module in communication with the temperature sensor and the humidity sensor, the control module. The control module is configured to: receive a set point temperature value and a set point humidity value, receive a measured air temperature value from the temperature sensor, receive a measured air humidity value from the humidity sensor, calculate a difference between the set point temperature value and the measured air temperature value to determine a temperature error value, calculate a difference between the set point humidity value and the measured humidity value to determine a humidity error value, and control operation of the at least one unit based on a comparison between the temperature error value and the humidity error value.

In accordance with some embodiments, the comparison performed by the control module includes determining which of the temperature error value and the humidity error value is greater. According to a further embodiment, the at least one unit includes a compressor, a heater, and a humidifier, and the control module is further configured to: control the operation of the humidifier if the humidity error value is greater than the temperature error value and the humidity error value is less than zero, control the operation of the compressor if the humidity error value is greater than the temperature error value and the humidity error value is greater than zero, control the operation of the compressor if the temperature error value is greater than the humidity error value and the temperature error value is greater than zero, and control the operation of the heater if the temperature error value is greater than the humidity error value and the temperature error value is less than zero.

According to another embodiment, the control module further includes: a first PID controller configured to receive the set point temperature value and the measured air temperature value and to calculate the difference between the set point temperature value and the measured air temperature value and to transmit the temperature error value, and a second PID controller configured to receive the set point humidity value and the measured air humidity value and to calculate the difference between the set point humidity value and the measured air humidity value and to transmit the humidity error value.

According to another embodiment, the control module is further configured to receive the temperature error value and the humidity error value and to perform the comparison between the temperature error value and the humidity error value.

According to another embodiment, the control module controls operation of the compressor to minimize the temperature error value or the humidity error value.

In accordance with at least one embodiment, the control module is configured to maintain the measured air humidity value to be within ±3% of the set point humidity value.

In accordance with certain embodiments, the control module is configured to maintain the measured air temperature value to be within ±1.1° C. of the set point temperature value.

According to some embodiments, the compressor is a variable speed compressor and the control module controls operation of the compressor by adjusting the amount of power provided to the compressor.

In accordance with various embodiments, the control module is configured to operate the compressor, the humidifier, and the heater in real time.

A second aspect of the invention is directed to an improved method of controlling humidity and temperature. The method includes receiving a set point temperature value and a set point humidity value, measuring an air temperature value and an air humidity value, calculating a difference between the set point temperature value and the measured air temperature value to determine a temperature error value, calculating a difference between the set point humidity value and the measured air humidity value to determine a humidity error value, and operating at least one unit configured to cool, heat, dehumidify, and humidify air based on a comparison between the temperature error value and the humidity error value.

According to some embodiments, comparing the temperature error value to the humidity error value includes determining which of the temperature error value and the humidity error value is greater.

In accordance with at least one embodiment, the at least one unit includes a compressor, a heater, and a humidifier, and operating the at least one unit includes: operating the humidifier if the humidity error value is greater than the temperature error value and the humidity error value is less than zero, operating the compressor if the humidity error value is greater than the temperature error value and the humidity error value is greater than zero, operating the compressor if the temperature error value is greater than the humidity error value and the temperature error value is greater than zero, and operating the heater if the temperature error value is greater than the humidity error value and the temperature error value is less than zero.

According to certain embodiments, the compressor is operated in a continuous mode. According to some embodiments, the compressor is operated to minimize the humidity error value or the temperature error value.

According to another embodiment, the air temperature value and the air humidity value are measured in real time.

According to another embodiment, the method further includes maintaining the measured air humidity value to be within ±3% of the set point humidity value. According to another embodiment, the method further includes maintaining the measured air temperature value to be within ±1.1° C. of the set point temperature value. According to a further embodiment, the method includes maintaining the measured air temperature air value and the measured air humidity value simultaneously.

A third aspect of the invention is directed to an improved system for controlling temperature and humidity of a conditioned space. The system includes: at least one temperature sensor, at least one humidity sensor, and means for controlling the temperature and the humidity by calculating a difference between a set point temperature value and a temperature value received by the at least one temperature sensor to determine a temperature error value, calculating a difference between a set point humidity value and a humidity value received by the at least one humidity sensor to determine a humidity error value, and comparing the temperature error value to the humidity error value.

According to another embodiment, the system further includes at least one unit configured to cool, heat, dehumidify, and humidify air, and the means for controlling further includes controlling the operation of the at least one unit based on the comparison between the temperature error value and the humidity error value.

Still other aspects, embodiments, and advantages of these example aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments. Embodiments disclosed herein may be combined with other embodiments, and references to "an embodiment," "an example," "some embodiments," "some examples," "an alternate embodiment," "various embodiments," "one embodiment," "at least one embodiment," "this and other embodiments," "certain embodiments," or the like are not necessarily mutually exclusive and are intended to indicate that a particular feature, structure, or characteristic described may be included in at least one embodiment. The appearances of such terms herein are not necessarily all referring to the same embodiment.

BRIEF DESCRIPTION OF DRAWINGS

Various aspects of at least one embodiment are discussed below with reference to the accompanying figures, which are not intended to be drawn to scale. The figures are included to provide an illustration and a further understanding of the various aspects and embodiments, and are incorporated in and constitute a part of this specification, but are not intended as a definition of the limits of any particular embodiment. The drawings, together with the remainder of the specification, serve to explain principles and operations of the described and claimed aspects and embodiments. For purposes of clarity, not every component may be labeled in every figure. In the figures:

DETAILED DESCRIPTION

Figure 1:
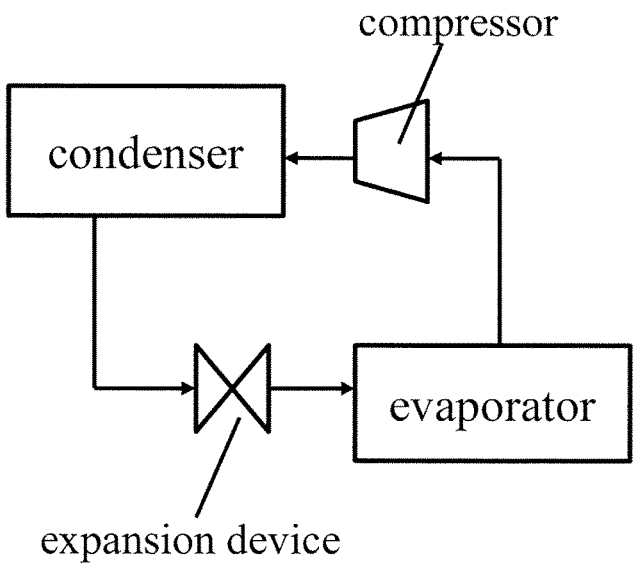
FIG. 1 is schematic illustration of a typical DX system.
Figure 2:
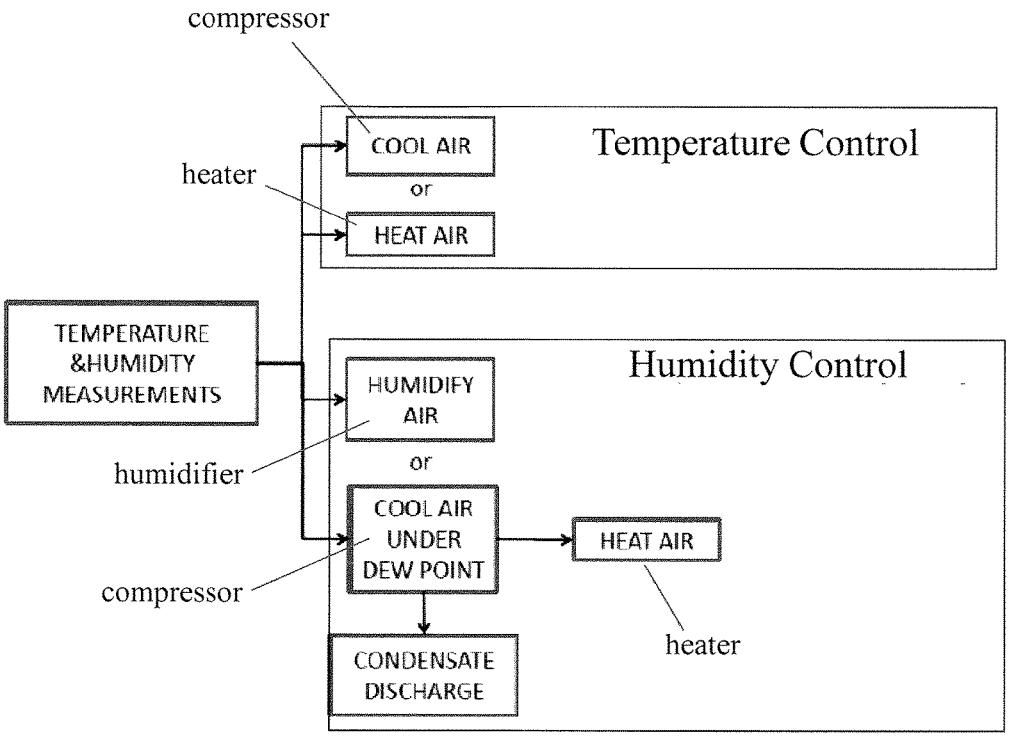
FIG. 2 (Prior Art)
FIG. 2 is a diagram of a temperature and humidity control system of a prior art embodiment.
Figure 3:
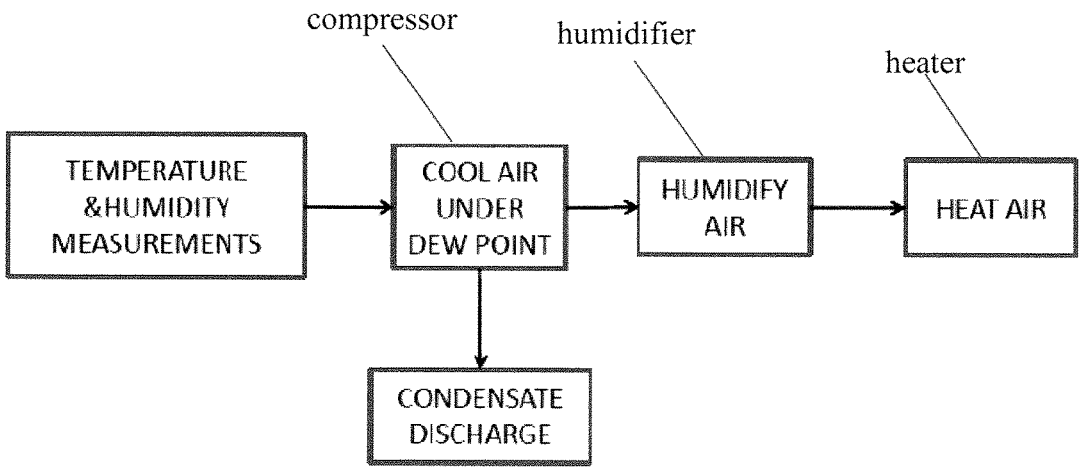
FIG. 3 (Prior Art)
FIG. 3 is a diagram of a temperature and humidity control system of another prior art embodiment.

Aspects of this disclosure are directed to a method and system for controlling both temperature and humidity. The system includes separate control feedback loops for temperature and humidity, from which a control action is derived for at least one of a compressor, heater, and humidifier. According to various aspects, the system uses a variable speed compressor, which can be linearly controlled and results in progressive regulation for both temperature and humidity. The control action is dictated by a maximum error associated with either the temperature or the humidity.

The methods and systems disclosed herein offer several advantages. For example, the temperature and humidity can be controlled with greater precision and the system uses less energy. For example, humidity can be controlled to be within about ±1% of the set point value, as compared to ±5% with a conventional DX system using a continuously running compressor, or ±7-8% with a conventional DX system using a compressor operating in an on/off mode (discontinuous mode). At the same time, temperature may also be controlled to be within ±0.3° C. of the set point value. Further, maintenance costs are lower, since neither the compressor nor the humidifier is run continuously.

The aspects disclosed herein in accordance with the present invention, are not limited in their application to the details of construction and the arrangement of components set forth in the following description or illustrated in the accompanying drawings. These aspects are capable of assuming other embodiments and of being practiced or of being carried out in various ways. Examples of specific implementations are provided herein for illustrative purposes only and are not intended to be limiting. In particular, acts, components, elements, and features discussed in connection with any one or more embodiments are not intended to be excluded from a similar role in any other embodiments.

Also, the phraseology and terminology used herein is for the purpose of description and should not be regarded as limiting. Any references to examples, embodiments, components, elements or acts of the systems and methods herein referred to in the singular may also embrace embodiments including a plurality, and any references in plural to any embodiment, component, element or act herein may also embrace embodiments including only a singularity. References in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. In addition, in the event of inconsistent usages of terms between this document and documents incorporated herein by reference, the term usage in the incorporated reference is supplementary to that of this document; for irreconcilable inconsistencies, the term usage in this document controls.

Figure 4:
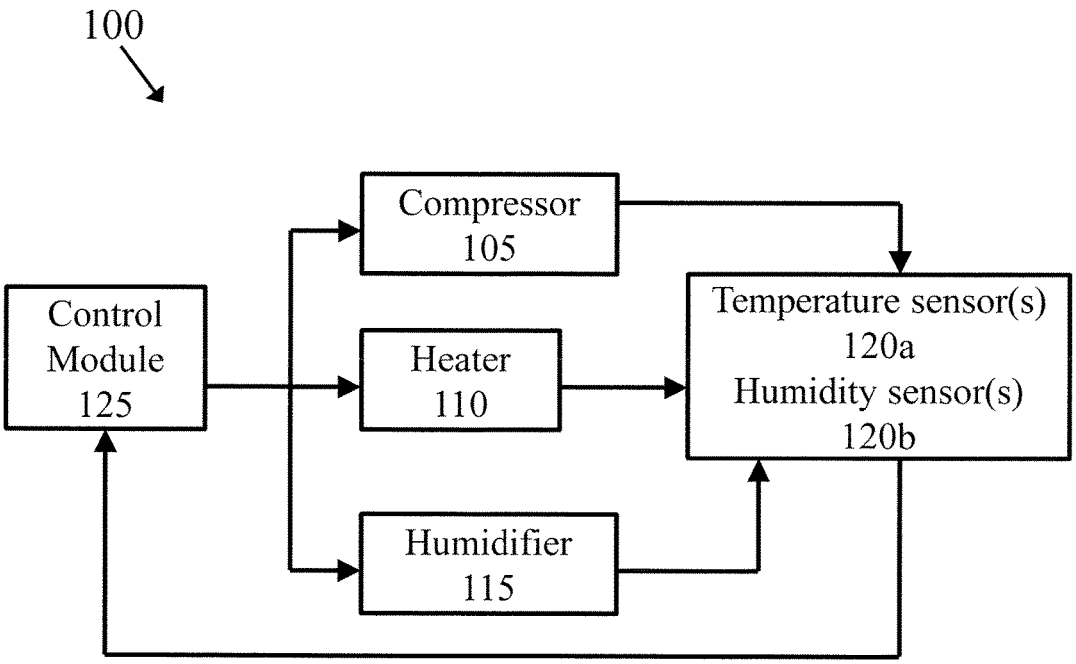
FIG. 4 is a schematic diagram illustrating a configuration of a temperature and humidity control system in accordance with one or more aspects of the disclosure.

Referring to the drawings, and more particularly to FIG. 4, there is generally indicated at 100 a humidity and temperature control system in accordance with at least one embodiment of the present invention to control both temperature and humidity for air within a conditioned space. The conditioned space may be one or more rooms or spaces located within a building or structure. In certain instances, the rooms or spaces may be located within a museum or other archive facility, or located within a measurement, manufacturing, cleanroom, lab, data center, or any other type of environment that may require close control of both temperature and humidity. According to one embodiment, the humidity and temperature control system 100 includes at least one temperature sensor 120*a*, at least one humidity sensor 120*b*, a compressor 105, a heater 110, a humidifier 115, and a control module 125. The temperature sensor 120*a* is configured to measure an air temperature value, such as the dry-bulb temperature, within a room or space where temperature and humidity control is desired, i.e., the conditioned space. The humidity sensor 120*b* is configured to measure an air humidity value within the same conditioned space as the temperature sensor 120*a*. As used herein, the term "humidity" refers to relative humidity, which is the ratio of the quantity of water vapor actually present in the air to that amount which would saturate the air at the same temperature, and is usually expressed in percent. Each of the temperature sensor 120*a* and the humidity sensor 120*b* may be positioned at one or more locations within the conditioned space. For example, multiple sensors may be positioned at various locations in the room(s) to obtain an aggregate or average temperature and/or humidity value. In other instances, a single sensor may suffice in obtaining a reasonably accurate measurement, such as in smaller spaces. Each of the temperature sensor 120*a* and the humidity sensor 120*b* are configured to transmit the measured values of the temperature and humidity, respectively, to the control module 125 in the form of feedback signals. As explained further below, the control module 125 uses the feedback signals to determine a deviation between the measured temperature and humidity values and their respective set point values, and then operates at least one of the compressor 105, the heater 110, and the humidifier 115 based on a comparison between these deviations.

In accordance with at least one embodiment, the compressor 105 is generally configured to cool and dehumidify air. According to some embodiments, the compressor 105 is associated with or otherwise part of a DX system, as discussed above. For example, a DX system that accomplishes cooling by using refrigerant and an evaporator coil may include the compressor 105 as well as other components, including an expansion valve and a condensing coil. In accordance with certain embodiments, the compressor 105 is a variable speed compressor. As used herein, the term "variable speed compressor" refers to a compressor whose speed can be controlled, for example, by a controller. The variable speed compressor includes a motor that is driven by a variable speed drive, and thus the speed of the compressor 105 may be controlled by the control module 125 by controlling the speed of the motor. For instance, the control module 125 uses frequency modulation to adjust power to the motor, which allows the motor to speed up or slow down, thereby allowing the amount of liquid refrigerant that is compressed to vary accordingly. In some embodiments, the variable speed compressor operates in a continuous mode, meaning that the operation speed of the motor is infinitely varied by the control module 125.

Figure 5:
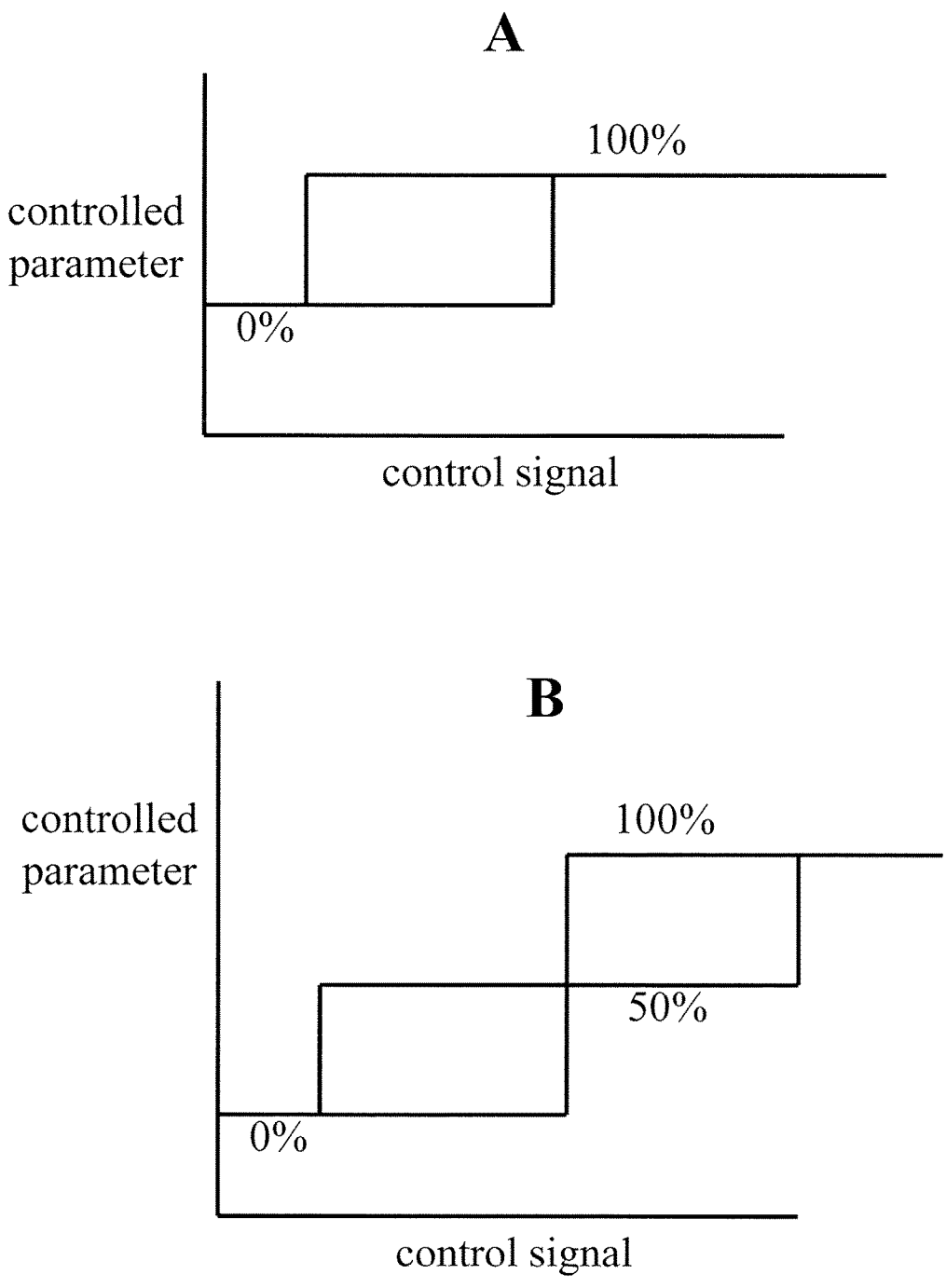
FIG. 5 is a pair of graphs illustrating a discontinuous regulation mode of control in accordance with one or more aspects of the disclosure.

In reference to FIG. 5, a discontinuous regulation mode of control is shown, where the control signal has two possible output states, namely ON and OFF, or 0% and 100%, as shown in graph "A" of FIG. 5. Using the compressor as an example, a compressor that is not driven by an inverter would be operated using a discontinuous regulation mode such that when the compressor is activated, it operates at 100% of the cooling capacity, and at 0% when deactivated. An example of a discontinuous regulation mode with three possible output states (0%, 50%, and 100%) is shown in graph "B" of FIG. 5, and as will be appreciated, more than three states are also possible. Using the compressor as an example, 50% signifies the compressor operating at 50% of the cooling capacity. In the discontinuous regulation mode, the output of the controller is discontinuous and not varying smoothly; i.e., there are discrete steps of regulation. As recognized by one of skill in the art, the discontinuous regulation mode may also be subjected to hysteresis compensation to avoid rapidly switching equipment on and off.

Figure 6:
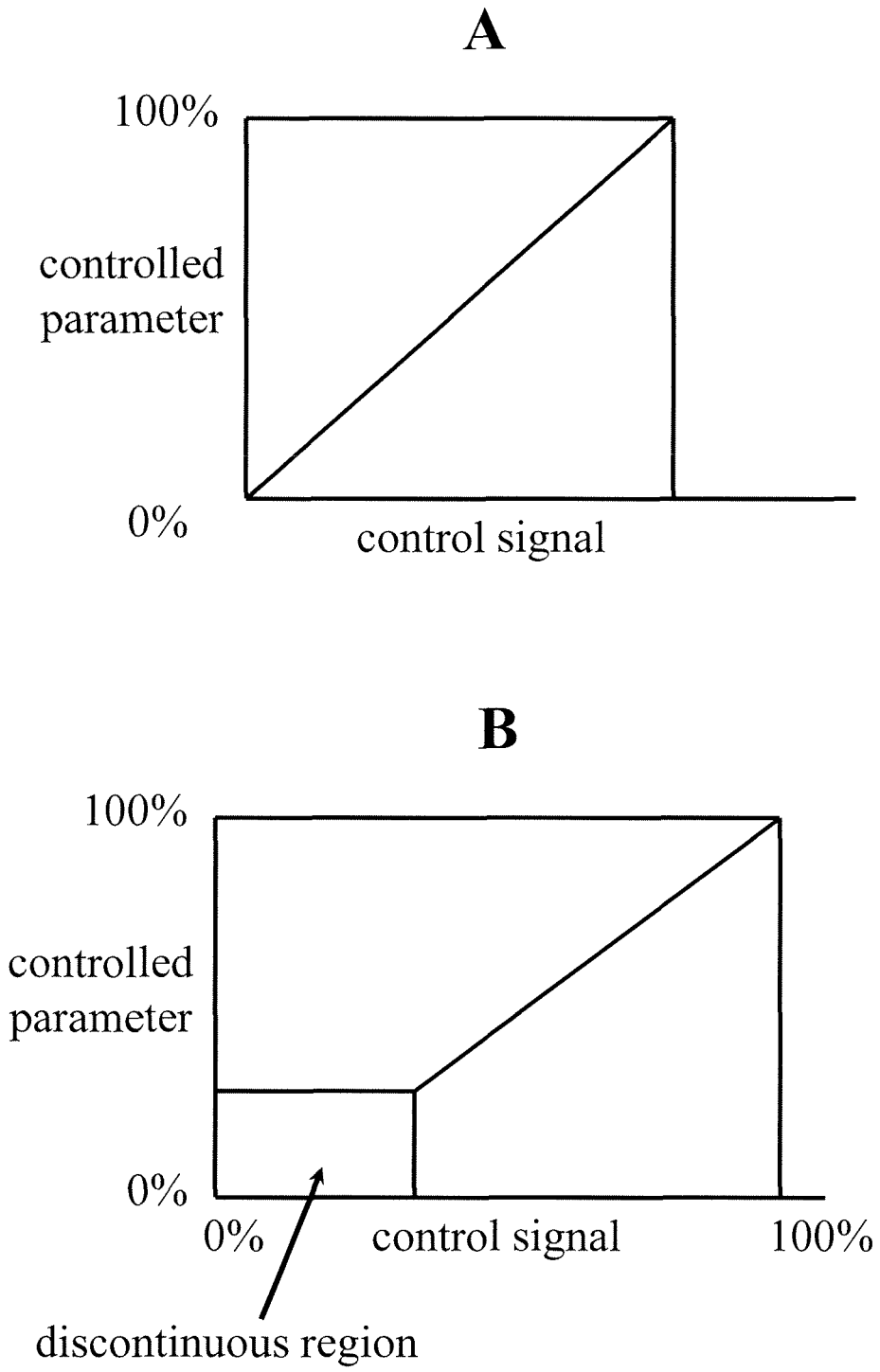
FIG. 6 is a pair of graphs illustrating a continuous regulation mode of control in accordance with one or more aspects of the disclosure.

In contrast, FIG. 6 illustrates a continuous regulation mode of control, where in graph "A" the control signal varies smoothly from 0 to 100 such that the controlled parameter varies continuously from 0% to 100%. The variable speed compressor described above is one example of a device that operates under a continuous regulation mode. For devices that are incapable of being controlled down to 0%, graph "B" of FIG. 6, shows a control scheme whereby at least a portion of the proportional region of the graph is operated under a discontinuous regulation mode.

Referring back to FIG. 4, according to some embodiments, the heater 110 may be any device that is configured to heat air. For example, the heater 110 may be a boiler, a furnace, or a heat pump that heats water, steam, or air, and transfers the heat to the air in the conditioned space via convection, conduction, and/or radiation. The heater 110 operates using one or more fuels, including solid fuels, liquids, and gases, or may operate using electricity. According to some embodiments, the heater 110 is an electric heater. In certain embodiments, the heater 110 is controlled under a continuous mode of operation, as described above in reference to FIG. 6. For example, the controlled parameter in this instance would be heat, and the heat may vary from 0 Watts, i.e., 0%, to 3000 Watts, i.e., 100% (depending on the heater). Thus, the amount of fuel or power directed to the heater 110 may be controlled by the control module 125, thereby producing varying amounts or varying degrees, i.e., higher or lower degree temperatures, of heated air.

In certain embodiments, the humidifier 115 is configured to humidify air. The humidifier 115 may be any device that evaporates water or otherwise provides moisture to air. Non-limiting examples of humidifiers include evaporative, steam, and ultrasonic types of humidifiers. According to at least one embodiment, the humidifier 115 is a steam humidifier. The humidifier 115 may be powered by electricity or a fuel, which may be controlled by the control module 125. According to some embodiments, the humidifier 115 is powered using electrical power. According to some embodiments, the humidifier operates in a continuous mode, such that the control module 125 controls power supplied to the humidifier 115, as described above in reference to FIG. 6. In accordance with one or more embodiments, the humidifier 115 may be any humidifier where the steam production rate can be controlled from 0% to 100%.

In accordance with various aspects, the systems and methods disclosed herein may include at least one unit that is configured to cool, heat, humidify, and dehumidify air. The at least one device may thus be configured to one or more of the functions described above in reference to the compressor, heater, and humidifier.

The control module 125 is in communication with the temperature sensor 120*a* and the humidity sensor 120*b*. For example, the control module 125 may be configured to receive the feedback signals corresponding to the measured temperature and humidity values and generated by the temperature and humidity sensors 120*a* and 120*b*, respectively. The control module 125 may also be configured to receive a set point temperature value and a set point humidity value. The control module 125 calculates a difference between the set point temperature value and the measured air temperature value to determine a temperature error value and also calculates a difference between the set point humidity value and the measured air humidity value to determine a humidity error value. As discussed in further detail below, the control module 125 controls the operation of at least one of the compressor 105, heater 110, and humidifier 115 based on a comparison between the temperature error value and the humidity error value.

Although not specifically shown, the humidity and control system disclosed herein, including the system 100 shown in FIG. 4, may also include one or more dampers, such as venting devices, and may include other devices, such as valves, ducts, filters, and fans to route air throughout the system. For example, air heated by the heater 110 may be provided to the conditioned space using one or more vents, ducts, and fans.

Figure 7:
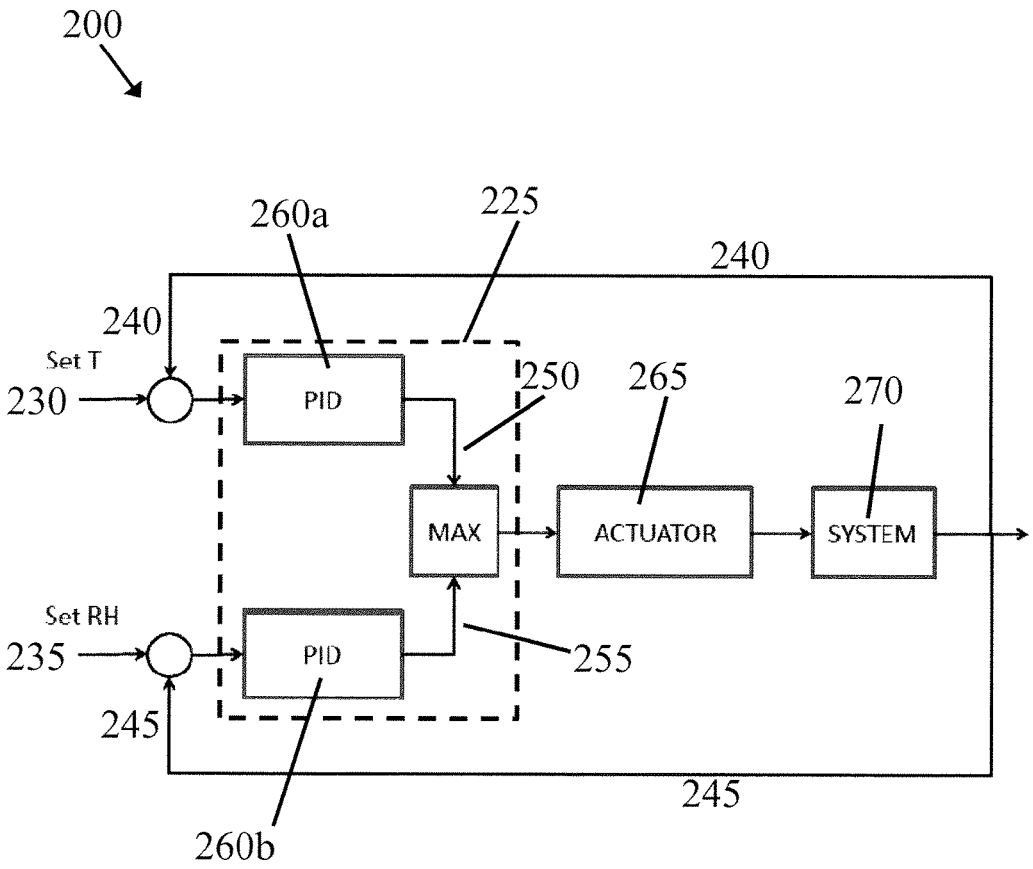
FIG. 7 is a schematic diagram of a control system in accordance with one or more aspects of the disclosure.

Referring to FIG. 7, the principle behind at least one embodiment of the disclosed humidity and temperature control system and method is shown generally at 200. A control module 225, which operates in a similar manner as the control module 125 discussed above in reference to FIG. 4, includes at least one proportional-integral-derivative controller (PID) controller, including a first PID controller 260*a* and a second PID controller 260*b*. Generally speaking, a proportional-integral-derivative controller (PID controller) is a type of control loop feedback mechanism that controls a process by monitoring a calculated deviation that represents the difference between a measured process variable and a desired set point. This type of controller attempts to minimize the deviation by adjusting the process control inputs. The first PID controller 260*a* is configured to receive a set point temperature value 230. The set point temperature value 230 corresponds to a desired temperature of air within the conditioned space 270, referenced as "system" in FIG. 7, and may be set by a user(s) using an interface, such as a graphical user interface that is coupled to the control module 225. The first PID controller 260*a* is also configured to receive the measured air temperature value 240 from one or more temperature sensors positioned within the conditioned space 270. In a similar manner, the second PID controller 260*b* is configured to receive a set point humidity value 235, where the set point humidity value 235 corresponds to a desired humidity level of the air within the conditioned space 270 and may also be set by a user, as described above. The second PID controller 260*b* is also configured to receive the measured air humidity value 245 from one or more humidity sensors positioned within the conditioned space 270.

In accordance with some embodiments, the first PID controller 260*a* calculates a difference between the set point temperature value 230 and the measured temperature value 240 to determine a temperature error value 250, and the second PID controller 260*b* calculates a difference between the set point humidity value 235 and the measured air humidity value 245 to determine a humidity error value 255. The control module 225 then performs a comparison between the temperature error value 250 and the humidity error value 255 to control operation of an actuator 265, where the actuator 265 is at least one of the compressor 105, heater 110, and humidifier 115 discussed above in reference to FIG. 4. These devices produce conditioned air that is then delivered to the conditioned space 270.

In operation, the control module 225 first compares the temperature error value 250 to the humidity error value 255 to determine which of these values is greater. As will be appreciated, the temperature and humidity values used by any of the control schemes discussed herein may be first normalized or otherwise weighted. For example, temperature and humidity values may each be normalized or otherwise scaled to values of between 0 and 1000. For example, a value of "0" can correspond to an error equal to zero (null value), and a value of 1000 can correspond to a pre-set error, such as 4° C., that is representative of a predetermined or stored value, such as a factory preset value. Thus, the control module 225 may use normalized values for purposes of comparison. The control action to the actuator 265 is then dictated by whichever of the temperature or humidity error values is greater. This means that the compressor 105 is regulated using errors associated with the greater demand.

To save on energy consumption, the operating scheme associated with the control scheme disclosed herein has two main principles: (1) if the humidity is greater than the set point, the air should be cooled to the minimum point where the temperature drops below the dew point, and (2) if the humidity value is less than the set point, then the air should be humidified to the minimum point to reach the set point humidity value. These principles require that the temperature and humidity be controlled at the same time.

Conventionally, compressor speed is regulated on the basis of the temperature of the air to be controlled, meaning that temperature control is always given precedence over control of humidity. The control scheme described herein allows for the humidity to be given precedence over temperature since the control action is based on the maximum error between the temperature and the humidity.

Once the control module 225 determines which of the temperature error value 250 and the humidity error value 255 is greater, the control module 225 controls the operation of at least one of the compressor 105, heater 110, and humidifier 115 (i.e., the actuator 265) based on the following criteria:

- If the humidity error value 255 is greater than the temperature error value 250 and the humidity error value 255 is less than zero, then the control module 225 controls the operation of the humidifier 115 to minimize the humidity error value 255.
- If the humidity error value 255 is greater than the temperature error value 250 and the humidity error value 255 is greater than zero, then the control module 225 controls the operation of the compressor 105 to minimize the humidity error value 255.
- If the temperature error value 250 is greater than the humidity error value 255 and the temperature error value 250 is greater than zero, then the control module 225 controls the operation of the compressor 105 to minimize the temperature error value 250.
- If the temperature error value 250 is greater than the humidity error value 255 and the temperature error value 250 is less than zero, then the control module 225 controls the operation of the heater 110 to minimize the temperature error value 250.

The operation scenarios described above indicate that operation of the compressor 105, heater 110, and humidifier 115 are dictated or driven by minimizing the corresponding temperature or humidity error value, i.e., driving this error to a null (zero) value. However, in accordance with some embodiments, the operation of the devices may be dictated by having the corresponding errors achieve a threshold or target value or range of values. For example, the heater may be operated such that the temperature error is <0.5° C., and in some instances, the heater may be operated such that the temperature error is <0.3° C.

Figure 8:
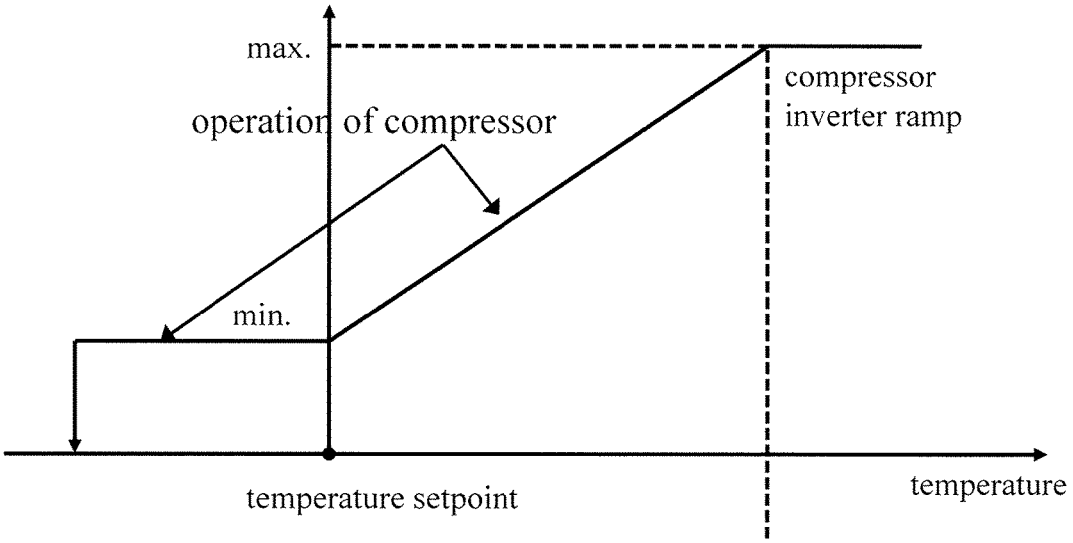
FIG. 8 is a graph illustrating a temperature control scheme in accordance with one or more aspects of the disclosure.
Figure 9:
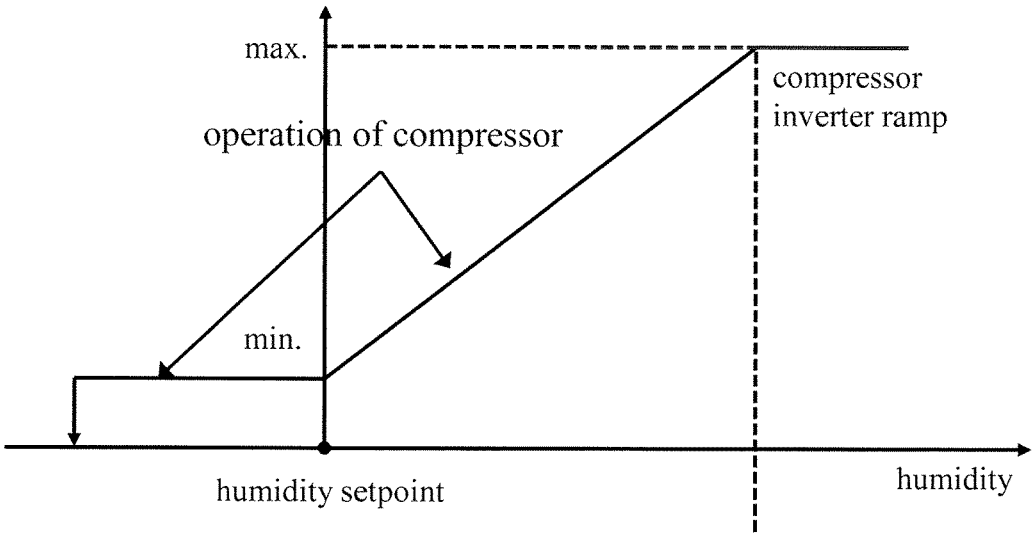
FIG. 9 is a graph illustrating a humidity control scheme in accordance with one or more aspects of the disclosure.

Functionally, the configuration described above allows for each of the temperature and humidity control loops to have their own PID controller from which a control action is derived. FIG. 8 illustrates the temperature control loop associated with the first PID controller 260*a* for temperature that controls operation of the compressor 105 when the temperature error value 250 is greater than the humidity error value 255 and the temperature error value 250 is greater than zero. As indicated in FIG. 8, instead of operating in a binary on/off mode, the speed of the compressor 105 is kept at a minimum value, which then increases according to the magnitude of the temperature error value 250. For example, the larger the temperature error value 250, i.e., the warmer the temperature of the air in the conditioned space 270, the greater the speed of the compressor 105 and the colder the temperature of air that is generated and directed to the conditioned space 270. A similar situation applies in FIG. 9, where the humidity control loop associated with the second PID controller 260*b* is illustrated for situations where the humidity error value 255 is greater than the temperature error value 250 and the humidity error value 255 is greater than zero. The speed of the compressor 105 is kept at a minimum, and then increased proportionally according to the magnitude of the humidity error value 255, i.e., the amount of over-humidification, since the compressor 105 functions as a dehumidifier under these conditions. For instance, the greater the humidity error value 255, the greater the speed of the compressor 105 and the drier the air that is generated and directed to the conditioned space 270.

In accordance with various embodiments, the control module 225 is configured to operate the compressor 105, the heater 110, and the humidifier 115 in real time. As used herein, the term "real time" refers to a method where sensor values from the temperature and humidity sensors 120*a* and 120*b* are transmitted and received by the control module 225 through instantaneous or near-instantaneous periodic monitoring. For example, every second or every half-second temperature and/or humidity measurements may be obtained by the sensors 120*a* and 120*b* and transmitted to the control module 225. Rates associated with the heating, cooling, and humidifying devices, such as heating air at X ° C./minute, may be included as one or more of the control parameters included in the PID control loop associated with each of the PID controllers 260*a* and 260*b*.

Using the control scheme described above, the measured air humidity value 245 may be maintained to be within ±1-3% of the set point humidity value 235. In addition, the disclosed control scheme allows for the measured air temperature value 240 to be maintained within ±0.3-1.1° C. of the set point temperature value 230. Since temperature and humidity have an interdependent relationship with each other, the degree of control on one of these parameters influences the other. Therefore, according to one embodiment, the air humidity may be within ±3% of the set point humidity value and the temperature may be within ±1.1° C. of the set point temperature value. According to another embodiment, the air humidity may be within ±2% of the set point humidity value and the temperature may be within ±0.7° C. of the set point temperature value. According to yet another embodiment, the air humidity may be within ±1% of the set point humidity value and the temperature may be within ±0.3° C. of the set point temperature value.

According to some embodiments, the control module may take the form of a microprocessor or other computer, as understood by one of skill in that art that includes hardware and software components. As shown in FIG. 4, the control module 225 may include or otherwise interface with the first and second PID controllers 260*a* and 260*b*. In certain embodiments, the PID controllers 260*a* and 260*b* may be separate pieces of hardware that are coupled and associated with the control module 225. In other embodiments, the PID controllers 260*a* and 260*b* may be integrated within the hardware of the control module 125 itself. The control module 225 is also in communication with the temperature and humidity sensors 120*a* and 120*b*, as discussed above, as well as the compressor 105, heater 110, and humidifier 115.

An example of different temperature and humidity scenarios is shown below in Table 1. Also shown is a responsive control action of the control system. For purposes of this table, the set point temperature value is 23° C. and the set point humidity value is 45%.

TABLE 1

Example Temperature and Humidity Control Examples

| Measured air temperature value (° C.) | Temperature error value | Measured air humidity value (%) | Humidity error value | Responsive Action |
|---|---|---|---|---|
| 35 | 12 | 75 | 30 | compressor |
| 33 | 10 | 50 | 5 | compressor |
| 20 | −3 | 65 | 20 | compressor |
| 10 | −13 | 50 | 5 | heater |
| 10 | −13 | 40 | −5 | heater |
| 15 | −8 | 30 | −15 | humidifier |
| 30 | 7 | 30 | −15 | humidifier |
| 40 | 17 | 40 | −5 | compressor |
| 33 | 10 | 55 | 10 | no action |
| 18 | −5 | 40 | −5 | no action |

As indicated above in Table 1, in the event that the error value is the same for both humidity and temperature, then no responsive action is taken. Thus, according to certain aspects, the control module does not take action until one error value is greater than the other error value.

Figure 10:
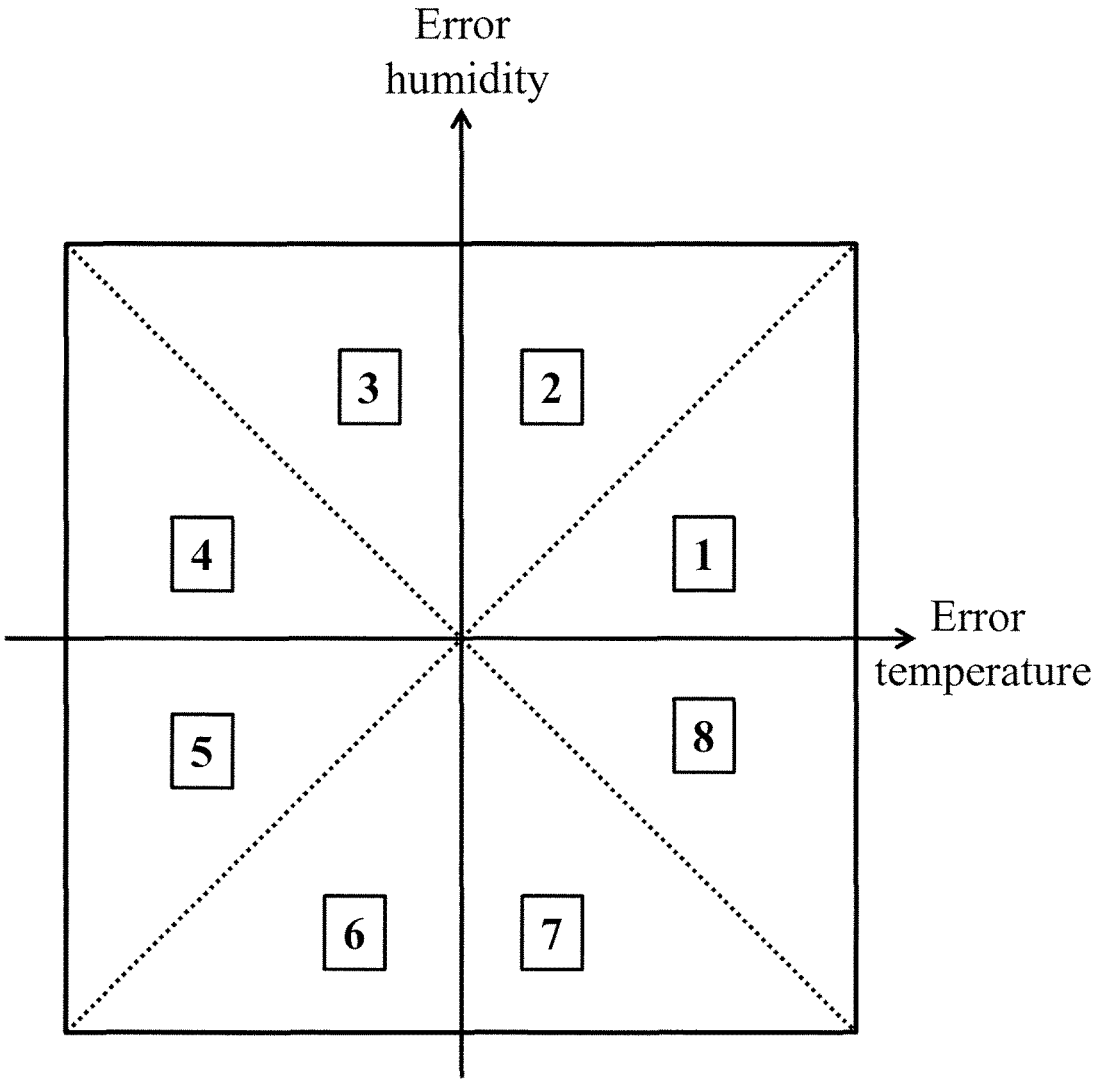
FIG. 10 is a graph corresponding to a control scheme in accordance with one or more aspects of the disclosure.

Referring to FIG. 10 and Table 2, the responsive action of the compressor, heater, or humidifier based on the relationship between the temperature and error values is shown. For example, in region "1" of the graph shown in FIG. 10, the temperature error value is greater than the humidity error value, and therefore, the compressor is operated to minimize the temperature error value, which corresponds with the example in the second line of Table 1 above.

TABLE 2

Responsive Action Based on Magnitude of Temperature vs. Humidity Errors

| Region in FIG. 10 | Compressor | Heater | Humidifier |
|---|---|---|---|
| 1 | ON | OFF | OFF |
| 2 | ON | OFF | OFF |
| 3 | ON | OFF | OFF |
| 4 | OFF | ON | OFF |
| 5 | OFF | ON | OFF |
| 6 | OFF | OFF | ON |

TABLE 2-continued

Responsive Action Based on Magnitude of Temperature vs. Humidity Errors

| Region in FIG. 10 | Compressor | Heater | Humidifier |
|---|---|---|---|
| 7 | OFF | OFF | ON |
| 8 | ON | OFF | OFF |

Figure 11:
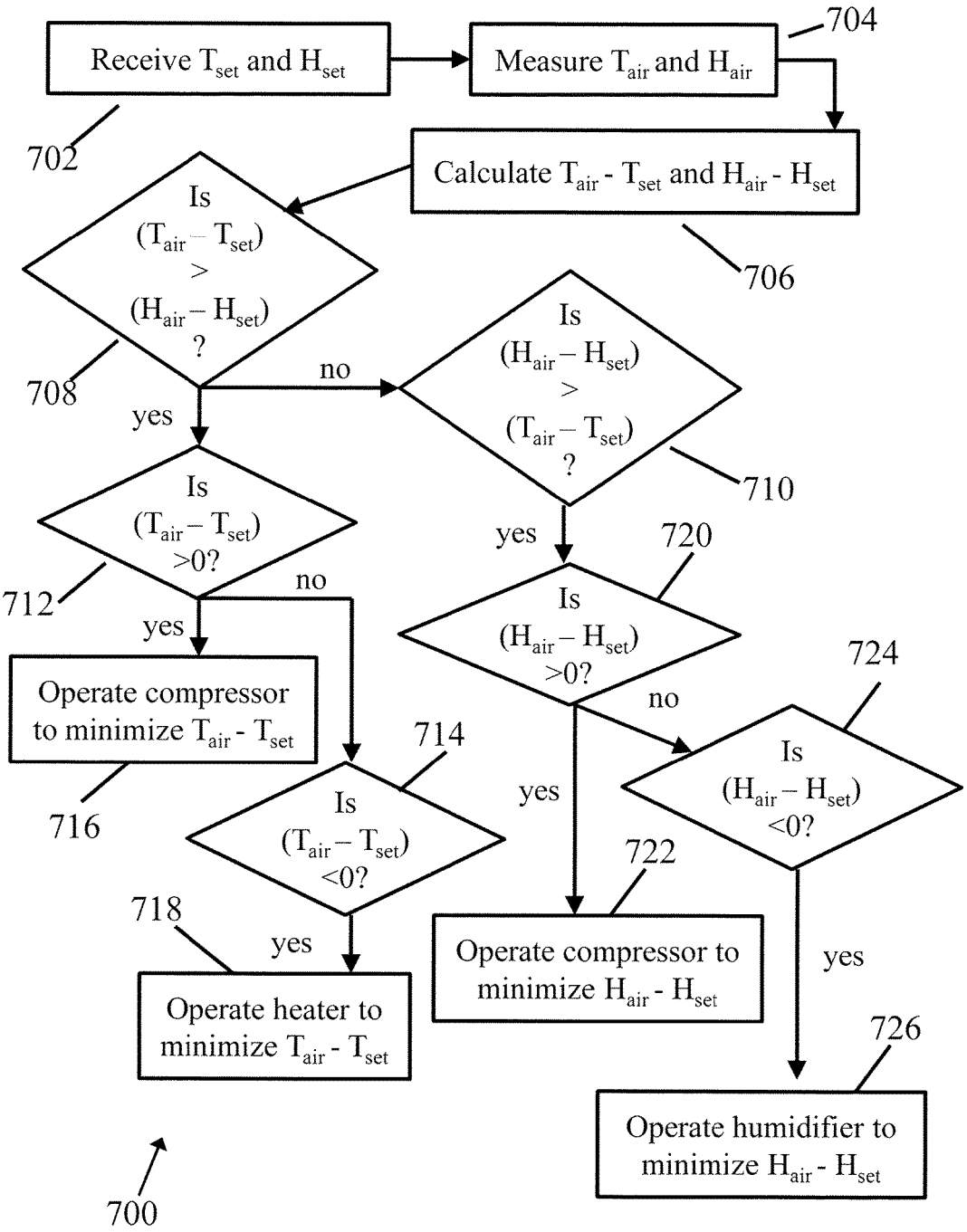
FIG. 11 is a flow diagram illustrating a process for controlling temperature and humidity in accordance with one or more aspects of the disclosure.

According to another embodiment, an example control scheme or process, generally indicated at 700, is illustrated by the flow chart in FIG. 11. This control scheme may be used by the control module discussed above. In the flow chart, $T_{air}$ is the measured air temperature value, $T_{set}$ is the set point temperature value, $H_{air}$ is the measured air humidity value, and $H_{set}$ is the set point humidity value.

The process starts at step 702, where the set point values $T_{set}$ and $H_{set}$ are received. These values may be set by a user and entered via a user interface that is associated with the control module, or the control module may set the values. At step 704, the air temperature $T_{air}$ and air humidity $H_{air}$ values are measured, for example, by temperature and humidity sensors, as discussed above. These values are compared against the set point values in step 706, where $T_{air}-T_{set}$ and $H_{air}-H_{set}$ are calculated. At step 708, a determination is made as to whether $T_{air}-T_{set}$ is greater than $H_{air}-H_{set}$, meaning that the system determines the maximum error between temperature and humidity. If yes, meaning that error associated with the temperature error is greater than the error associated with the humidity, then the process proceeds to step 712, where another determination is made as to whether $T_{air}-T_{set}$ is greater than zero, which means that the air in the conditioned space is warmer than the set point temperature value. If yes, then the process proceeds to step 716, where the compressor is operated to cool the air in the conditioned space. In certain instances, the compressor may be operated to minimize the temperature error value corresponding to $T_{air}-T_{set}$. If the answer to step 712 is no, then a determination may be made at step 714 as to whether $T_{air}-T_{set}$ is less than zero, meaning that the air in the conditioned space is cooler than the set point temperature value. If the answer is yes, then the heater is operated to warm the air in the conditioned space at step 718. According to certain aspects, the heater may be operated to minimize the temperature error value corresponding to $T_{air}-T_{set}$.

Returning to step 708, if the determination is made that the temperature error value is not greater than the humidity error value, i.e., $T_{air}-T_{set}$ is not greater than $H_{air}-H_{set}$, then the process may proceed to step 710, where a determination is made as to whether the humidity error value is greater than the temperature error values, i.e., $H_{air}-H_{set}$ is greater than $T_{air}-T_{set}$. If yes, then the process proceeds to step 720 where a determination is made as to whether $H_{air}-H_{set}$ is greater than zero, indicating that the humidity of the air in the conditioned space is higher than the set point value. If yes, then the compressor is operated at step 722 to dehumidify the air, which in certain instances means minimizing the humidity error value. If the answer to step 720 is no, then an inquiry is made at step 724 as to whether the humidity of the air in the conditioned space is less than the set point value, meaning that the air in the conditioned space is drier than the set point value. If yes, at step 726, the humidifier is operated to humidify the air in the conditioned space. In certain instances, the humidifier may be operated to minimize the humidity error value corresponding to $H_{air}-H_{set}$.

Process 700 depicts one particular sequence of acts in a particular embodiment. The acts included in this process may be performed by, or use, one or more computer systems or devices specially configured as discussed herein. Some acts are optional and, as such, may be omitted in accord with one or more embodiments. Additionally, the order of acts can be altered, or other acts can be added, without departing from the scope of the embodiments described herein. Furthermore, as described above, in at least one embodiment, the acts are performed on particular, specially configured machines, namely a control module configured according to the examples and embodiments disclosed herein.

In accordance with at least one embodiment, the systems and methods disclosed herein may be used in a retrofit type of application. For example, a kit or other assembly can be prepared that includes the control module and optionally one or more other components, such as the temperature and/or humidity sensors, the compressor, including a variable speed compressor, the heater, and the humidifier. For instance, a system that already includes a heater, humidifier, temperature and humidity sensors, and a single-speed compressor can by retrofit by swapping out the single-speed compressor and replacing with a variable speed compressor. A control module as discussed herein can also be installed to operate the system according to the control scheme presented herein.

Example 1

Figure 12:
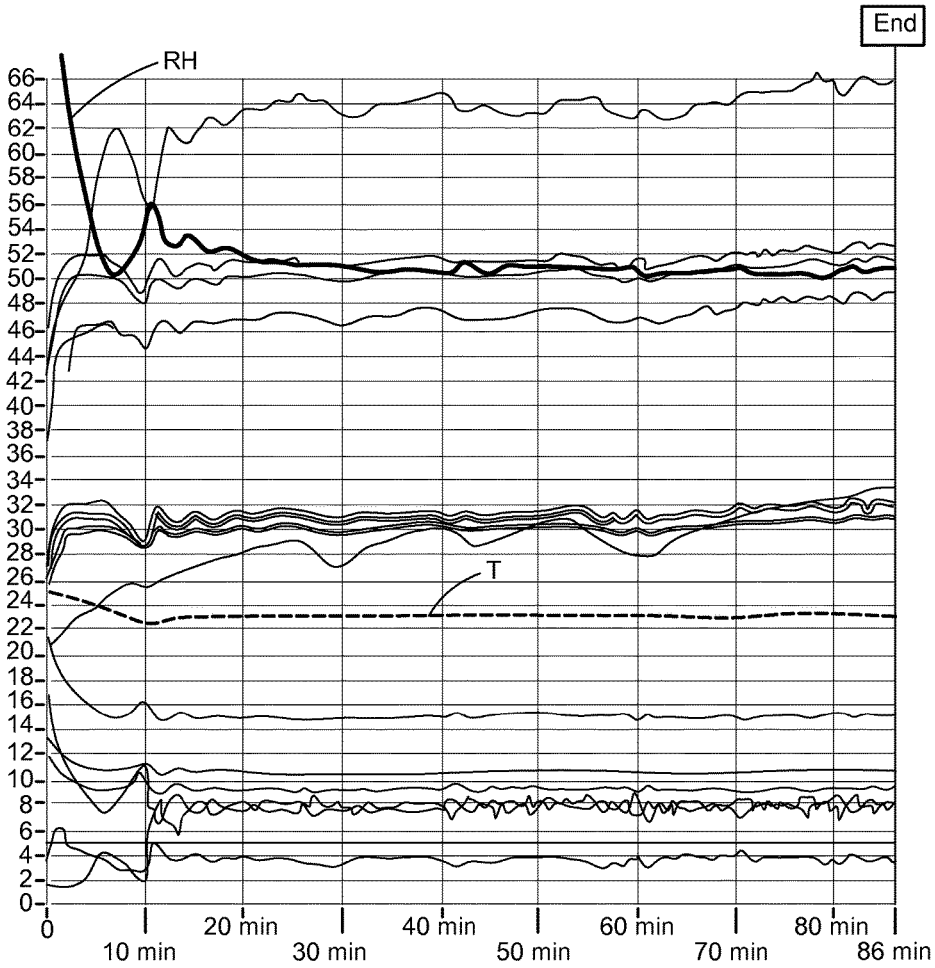
FIG. 12 is a graph illustrating humidity and temperature measurements from a system using a control scheme in accordance with one or more aspects of the disclosure.

An example of the humidity and temperature control system and method described herein was prepared and tested. The set point temperature value was 23° C. and the set point humidity level was 50%. The system started with initial (measured) temperature and humidity values of 26° C. and 68%, respectively. The graph shown in FIG. 12 shows the results of measured humidity values (indicated by "RH") and measured temperature values (indicated by "T") over time. As shown, the control system was capable of altering the initial temperature and humidity values to reflect the set point values, and further, to simultaneously maintain the measured air humidity value to be within ±1% of the set point humidity value and maintain the measured air temperature value to be within ±0.2° C. of the set point temperature value.

Example 2

Figure 13:
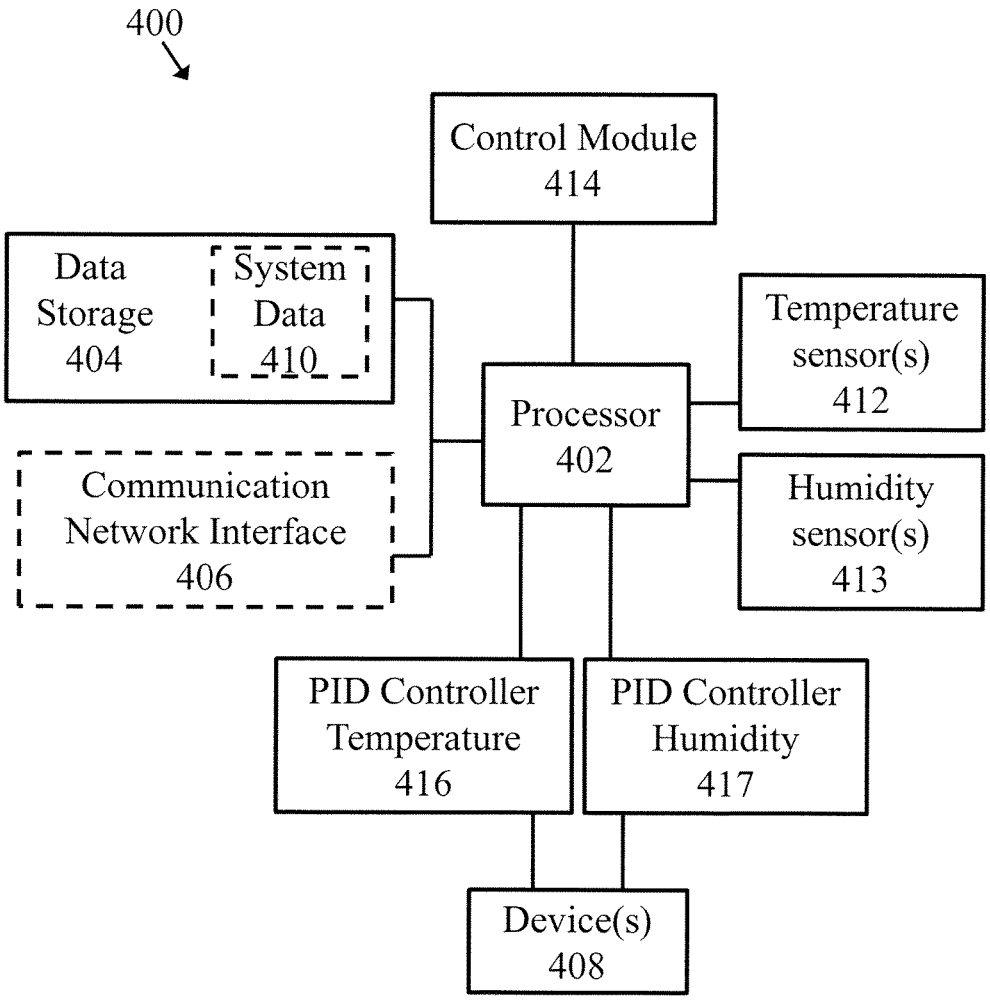
FIG. 13 is functional block diagram of a temperature and humidity control system in accordance with one or more aspects of the disclosure.

FIG. 13 illustrates a temperature and humidity control system 400 that is configured to control the temperature and humidity of the air within a conditioned space. As shown in FIG. 13, the temperature and humidity control system 400 comprises a processor 402 coupled to data storage 404, an optional communication network interface 406, a PID controller for temperature 416, a PID controller for humidity 417, temperature sensor(s) 412, humidity sensor(s) 413, and a control module 414. The data storage 404 may also optionally store system data 410. The secondary controller(s) 416 are coupled to one or more devices 408 that are configured to cool, heat, and dehumidify air, such as a compressor, heater, or humidifier.

According to the embodiment illustrated in FIG. 13, the processor 402 performs a series of instructions that result in manipulated data that is stored and retrieved from the data storage 404. According to some embodiments, the processor 402 is a commercially available processor, such as a processor manufactured by Texas Instruments, Intel, AMD, Sun, IBM, Motorola, and ARM Holdings, for example. It is appreciated that the processor 402 may be any type of processor, multiprocessor or controller, whether commercially available or specially manufactured.

In addition, in several embodiments the processor 402 is configured to execute a conventional real-time operating system (RTOS), such as RTLinux. In these examples, the RTOS may provide platform services to application software, such as software associated with the control module 414 and PID controllers 416 and 417 for temperature and humidity, as described above. These platform services may include inter-process and network communication, file system management, and standard data store manipulation. One or more operating systems may be used, and examples are not limited to any particular operating system or operating system characteristic. For instance, in some examples, the processor 402 may be configured to execute a non-real time operating system, such as BSD or GNU/Linux. It is appreciated that the processor 402 may execute an Operating System Abstraction Library (OSAL).

The control module 414 and PID controllers 416 and 417 may be implemented using hardware, software, or a combination of hardware and software. For instance, in one example, the control module 414 and PID controllers 416 and 417 are implemented as software components that are stored within the data storage 404 and executed by the processor 402. In this example, the instructions included in the control module 414 program the processor 402 to generate control signals for the one or more devices 408 coupled to the PID controllers 416 and 417. As discussed above, the instructions included in the control module 414 may be based on a control strategy as described above in reference to FIG. 7. In other examples, the control module 414 and PID controllers 416 and 417 may each be an application-specific integrated circuit (ASIC) that is coupled to the processor 402. Thus, examples of the control module 414 and PID controllers 416 and 417 are not limited to a particular hardware or software implementation. The temperature and humidity control system 400 may execute one or more processes to control the temperature and the humidity of the air within the conditioned space. One example of a process performed by the control module 414 and PID controllers 416 and 417 is discussed above in reference to FIG. 11.

According to some embodiments, one or more of the components disclosed herein, such as the control module 414 and PID controllers 416 and 417, may read parameters that affect the functions they perform. These parameters may be physically stored in any form of suitable memory including volatile memory, such as RAM, or nonvolatile memory, such as a flash memory or magnetic hard drive. In addition, the parameters may be logically stored in a proprietary data structure, such as a database or file defined by a user mode application, or in a commonly shared data structure, such as an application registry that is defined by an operating system.

The data storage 404 includes a computer readable and writeable nonvolatile data storage medium configured to store non-transitory instructions and data. In addition, the data storage 404 includes processor memory that stores data during operation of the processor 402. In some examples, the processor memory includes a relatively high performance, volatile, random access memory such as dynamic random access memory (DRAM), static memory (SRAM) or synchronous DRAM. However, the processor memory may include any device for storing data, such as a nonvolatile memory, with sufficient throughput and storage capacity to support the functions described herein. According to several examples, the processor 402 causes data to be read from the nonvolatile data storage medium into the processor memory prior to processing the data. In these examples, the processor 402 copies the data from the processor memory to the non-volatile storage medium after processing is complete. A variety of components may manage data movement between the non-volatile storage medium and the processor memory and examples are not limited to particular data management components. Further, examples are not limited to a particular memory, memory system, or data storage system.

The instructions stored on the data storage 404 may include executable programs or other code that can be executed by the processor 402. The instructions may be persistently stored as encoded signals, and the instructions may cause the processor 402 to perform the functions described herein. The data storage 404 also may include information that is recorded, on or in, the medium, and this information may be processed by the processor 402 during execution of instructions. For example, the medium may be optical disk, magnetic disk, or flash memory, among others, and may be permanently affixed to, or removable from, the temperature and humidity control system 400.

In some embodiments, the system data 410 includes data used by the control module 414 to improve the temperature and humidity control strategy. More particularly, the system data 410 may include physical data related to the conditioned space, such as data that may used for generating a thermal model of the system. The system data 410 may be stored in any logical construction capable of storing information on a computer readable medium including, among other structures, flat files, indexed files, hierarchical databases, relational databases or object oriented databases. These data structures may be specifically configured to conserve storage space or increase data exchange performance. In addition, various examples organize the system data 410 into particularized and, in some cases, unique structures to perform the functions disclosed herein. In these examples, the data structures are sized and arranged to store values for particular types of data, such as integers, floating point numbers, character strings, arrays, linked lists, and the like. It is appreciated that the control module 414 and the system data 410 may be combined into a single component or re-organized so that a portion of the system data 410 is included in the control module 414. Such variations in these and the other components illustrated in FIG. 13 are intended to be within the scope of the embodiments disclosed herein.

As shown in FIG. 13, the temperature and humidity control system 400 also includes communication network interface 406, one or more devices 408, temperature sensor(s) 412, and humidity sensor(s) 413. Each of these components is a specialized device or is configured to exchange (i.e., send or receive) data with one or more specialized devices that may be located within the temperature and humidity control system 400 or elsewhere. Each of these components may include hardware, software, or a combination of both hardware and software that functions to physically and logically couple one or more elements with one or more other elements of the temperature and humidity control system 400. This physical and logical coupling enables the temperature and humidity control system 400 to communicate with and, in some instances, power or control the operation of one or more components. For example, the communication network interface 406 may be coupled to a communication device that is powered and/or controlled by the processor 402 through the communication network interface 406.

According to various examples, the hardware and software components of the communication network interface 406, device(s) 408, temperature sensor(s) 412, and humidity sensor(s) 413 implement a variety of coupling and communication techniques. In some examples, these components use leads, cables or other wired connectors as conduits to exchange data. In other examples, wireless technologies such as radio frequency or infrared technology are used. Software components that may be included in these devices enable the processor 402 to communicate with other components of the temperature and humidity control system 400. The software components may include elements such as objects, executable code, and populated data structures. According to at least some examples, where one or more components of the temperature and humidity control system 400 communicate using analog signals, the communication network interface 406, device(s) 408, temperature sensor(s) 412, and humidity sensor(s) 413 further include components configured to convert analog information into digital information, and vice-versa, to enable the processor 402 to communicate with one or more components of the temperature and humidity control system 400.

In some embodiment, the temperature and humidity control system 400 includes the communication network interface 406. In these embodiments, the components of the communication network interface 406 couple the processor 402 to one or more communication devices. To ensure data transfer is secure, in some examples, the temperature and humidity control system 400 can transmit secure data via the communication network interface 406 using a variety of security measures. In other examples, the network interface 406 includes both a physical interface configured for wireless communication and a physical interface configured for wired communication. In some examples, the temperature control system 400 is configured to exchange temperature, humidity, or other types of information with an external system via one or more communication devices coupled to the communication network interface 406.

The PID controllers 416 and 417 include a combination of hardware and software components that allow the temperature and humidity control system 400 to communicate with one or more devices 408 (e.g., heater, compressor, humidifier). For example, the PID controllers 416 and 417 may generate one or more control signals based on data transmitted from the processor 402 and originating from the control module 414, and communicate the control signals to the device(s) 408 to adjust the temperature and/or humidity of the air in the conditioned space.

Having thus described several aspects of at least one example, it is to be appreciated that various alterations, modifications, and improvements will readily occur to those skilled in the art. For instance, examples disclosed herein may also be used in other contexts. Such alterations, modifications, and improvements are intended to be part of this disclosure, and are intended to be within the scope of the examples discussed herein. Accordingly, the foregoing description and drawings are by way of example only.

What is claimed is:

1. A humidity and temperature control system comprising:

a temperature sensor configured to measure an air temperature value;

a humidity sensor configured to measure an air humidity value;

at least one unit configured to cool, heat, dehumidify, and humidify air, the at least one unit including a variable speed compressor, a heater, and a humidifier; and a control module in communication with the temperature sensor and the humidity sensor, the control module comprising:

a first PID temperature controller configured to:

receive a set point temperature value;

receive a measured air temperature value from the temperature sensor;

calculate a difference between the set point temperature value and the measured air temperature value to determine a temperature error value; and a second PID humidity controller configured to:

receive a set point humidity value;

receive a measured air humidity value from the humidity sensor;

calculate a difference between the set point humidity value and the measured humidity value to determine a humidity error value; and wherein the temperature error value corresponds to a normalized temperature error value and the humidity error value corresponds to a normalized humidity error value and the control module is configured to;

determine which of the normalized temperature error value and the normalized humidity error value is greater;

control operation of the humidifier if the normalized humidity error value is greater than the normalized temperature error value and the normalized humidity error value is less than zero;

control operation of the compressor if the normalized humidity error value is greater than the normalized temperature error value and the normalized humidity error value is greater than zero;

control operation of the compressor if the normalized temperature error value is greater than the normalized humidity error value and the normalized temperature error value is greater than zero; and control operation of the heater if the normalized temperature error value is greater than the normalized humidity error value and the normalized temperature error value is less than zero.

2. The humidity and temperature control system of claim 1, wherein the control module controls operation of the compressor to minimize the normalized temperature error value or the normalized humidity error value.

3. The humidity and temperature control system of claim 1, wherein the control module is configured to operate the humidity and temperature control system to a measured air humidity value within ±3% of the set point humidity value.

4. The humidity and temperature control system of claim 1, wherein the control module is configured to operate the humidity and temperature control system to a measured air temperature value within ±1.1° C. of the set point temperature value.

5. The humidity and temperature control system of claim 1, wherein the control module controls operation of the compressor by adjusting the amount of power provided to the compressor.

6. The humidity and temperature control system of claim 1, wherein the control module is configured to operate the compressor, the humidifier, and the heater in real time.

7. A method of controlling humidity and temperature comprising:

receiving a set point temperature value and a set point humidity value;

measuring an air temperature value and an air humidity value;

calculating a difference between the set point temperature value and the measured air temperature value to determine a temperature error value, the temperature error value corresponding to a normalized temperature error value;

calculating a difference between the set point humidity value and the measured air humidity value to determine a humidity error value, the humidity error value corresponding to a normalized humidity error value;

comparing the normalized temperature error value to the normalized humidity error value to determine which of the normalized temperature error value and the normalized humidity error value is greater; and operating continuously at least one unit that includes a variable speed compressor, a heater, and a humidifier and is configured to cool, heat, dehumidify, and humidify air by:

operating the humidifier if the normalized humidity error value is greater than the normalized temperature error value and the normalized humidity error value is less than zero;

operating the compressor if the normalized humidity error value is greater than the normalized temperature error value and the normalized humidity error value is greater than zero;

operating the compressor if the normalized temperature error value is greater than the normalized humidity error value and the normalized temperature error value is greater than zero; and operating the heater if the normalized temperature error value is greater than the normalized humidity error value and the normalized temperature error value is less than zero.

8. The method of claim 7, wherein the compressor is operated in a continuous mode, and to minimize the normalized humidity error value or the normalized temperature error value.

9. The method of claim 7, wherein the air temperature value and the air humidity value are measured in real time.

10. The method of claim 7, further comprising maintaining the measured air humidity value to be within ±3% of the set point humidity value.

11. The method of claim 10, further comprising maintaining the measured air temperature value to be within ±1.1° C. of the set point temperature value.

12. The method of claim 11, further comprising maintaining the measured air temperature air value and the measured air humidity value simultaneously.

13. A system for controlling temperature and humidity of a conditioned space, the system comprising:

at least one unit that includes a variable speed compressor, a heater, and a humidifier and is configured to cool, heat, dehumidify, and humidify air;

at least one temperature sensor;

at least one humidity sensor; and means for controlling the temperature and the humidity by;

calculating a difference between a set point temperature value and a temperature value received by the at least one temperature sensor to determine a temperature error value, the temperature error value corresponding to a normalized temperature error value;

calculating a difference between a set point humidity value and a humidity value received by the at least one humidity sensor to determine a humidity error value, the humidity error value corresponding to a normalized humidity error value; and comparing the normalized temperature error value to the normalized humidity error value to determine which of the normalized temperature error value and the normalized humidity error value is greater;

control operation of the humidifier if the normalized humidity error value is greater than the normalized temperature error value and the normalized humidity error value is less than zero;

control operation of the compressor if the normalized humidity error value is greater than the normalized temperature error value and the normalized humidity error value is greater than zero;

control operation of the compressor if the normalized temperature error value is greater than the normalized humidity error value and the normalized temperature error value is greater than zero; and control operation of the heater if the normalized temperature error value is greater than the normalized humidity error value and the normalized temperature error value is less than zero.

* * * * *